United States Patent [19]

Taylor

[11] Patent Number: 4,792,046

[45] Date of Patent: Dec. 20, 1988

[54] CONTAINER FORMED FROM FLAT SHEET OF FOAM PLASTIC

[76] Inventor: Paul A. Taylor, 979 Woodland Ave., San Leandro, Calif. 94597

[21] Appl. No.: 100,403

[22] Filed: Sep. 24, 1987

[51] Int. Cl.[4] ..... B65D 8/04

[52] U.S. Cl. ..... 206/523; 206/0.82; 206/515; 206/509; 220/70

[58] Field of Search ..... 206/523, 0.82, 515, 206/509; 220/66, 70

[56] References Cited

U.S. PATENT DOCUMENTS

| | | | |
|---|---|---|---|
| 2,961,123 | 11/1960 | Boydak et al. | 206/515 X |
| 3,195,770 | 7/1965 | Robertson | 206/519 X |
| 4,234,080 | 11/1980 | Gellert | 206/0.82 |
| 4,290,523 | 9/1981 | Wallace | 206/0.82 |
| 4,320,846 | 3/1982 | Meyering et al. | 220/23.8 X |

FOREIGN PATENT DOCUMENTS

| | | | |
|---|---|---|---|
| 595497 | 4/1960 | Canada | 206/0.82 |

*Primary Examiner*—William Price
*Attorney, Agent, or Firm*—George W. Wasson

[57] ABSTRACT

A hollow, cylindrical container is disclosed that is formed from a generally flat sheet of foamed plastic material. The sheet may be formed into the container and may be unformed back to its sheet form. The generally flat sheet has sector elements along each side that mate to form the top and bottom on the container while providing a hollow interior for contained materials. The container is adapted to contain and protect fluids, liquids or solids that are enclosed in their own packages and the container may be adapted with a tap or spigot for dispensing the contained materials. The container is easily stacked with like containers when in the generally flat sheet form so that the container may be used to transport materials when in its hollow, cylindrical form and may be returned to the shipping origin in its generally flat sheet form.

3 Claims, 1 Drawing Sheet

CONTAINER FORMED FROM FLAT SHEET OF FOAM PLASTIC

This invention relates to the art of packaging and more particularly to a novel cylindrical container formed from a three dimensional, generally flat sheet of material. The flat sheet may be opened to its flat form and may be closed upon itself to form a hollow cylindrical container with integral top and bottom closures.

BACKGROUND OF THE INVENTION

It is known in the art of packaging to form enclosing containers from blank sheet stock of various materials by folding the blank stock to form sides and tops of a container. In most applications of the folding of blank stock the materials are rigid board or paperboard with hinged segments that fold onto each other to form the sides, top and bottom of the containers. Such containers can be made to fold to an almost cylindrical form by making the blank with enough segments to make the folded and assembled form of the sides of the container almost a continuous circumference form.

It is also known to package liquid or fluid materials in protective containers where the contained materials are actually held in another package within the protective container to thus prevent damage to the package within the container. Such containers are usually rigid and somewhat strong to provide the desired protection to the contained package, and such containers are frequently more costly than more conventional containers made of rigid board or paperboard. Because of that increased cost, the more expensive containers are frequently returned to the source of origin for reuse. Empty, bulky containers create extra return shipping expenses because the container takes up space even though they may be lighter in weight than when filled. Those in the packaging and shipping industries have therefore become interested in protective packaging that can be returnable in a form that will not require the shipping of bulky, empty, space consuming containers.

SUMMARY OF THE PRESENT INVENTION

The container of the present invention is formed of a protective, light weight material that is rigid enough to be self supporting, formable into complex forms, flexible enough to permit the material to be folded into an assembly form, and unformable from folded form to permit stacking with similar formed units in a flat form. The container may be folded into a hollow cylindrical form providing a top and bottom for the container, may be provided with handles and strap accomodating araes to maintain the container in its folded form, and may provide an interior cavity that may contain separate packages of liquid, fluid or solid materials. The container may also be unfolded to its original, substantially flat, sheet like form for return to a point of origin in a less space consuming form.

An object of the present invention is the provision of a three dimensional, generally flat, sheet form of flexible, impact absorbing material that may be folded into a form other that the original sheet form to make a useable hollow container.

A further object in accord with the preceding object is the provision of a hollow container formed from a sheet form of flexible material that may be unfolded from the folded form to permit return to its original sheet form.

A further object of the present invention is the forming of a continuous sheet form that may be formed into a hollow cylindrical container with integral top and bottom surfaces and which may be unformed from the container form to it original sheet form and may be stacked in a space reducing stack with other sheet forms of similar construction.

Further objects and features of the present invention will be readily apparent to those skilled in this art from the appended drawings and specification illustrating a preferred embodiment wherein.

DETAILED DESCRIPTION OF THE INVENTION

Figure 1:
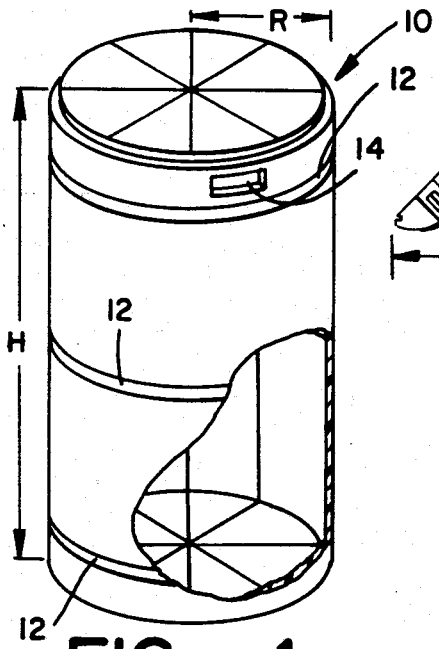
FIG. 1 is a perspective view of a cylindrical container formed from a generally flat sheet of formable material in accord with the present invention.

Referring now to FIG. 1 wherein is shown a completed cylindrical container 10 formed from a sheet of generally flat, flexible stock. In the cylindrical container shown, the sheet stock was formed into eight identical segments that formed the sheet and the segments were folded against each other to form the completed cylinder. A plurality of straps 12, here shown as three, are shown wrapped around the container to hold the container in its cylindrical form. The straps may be of any conventional form either as a continuous band or a strap provided with a joining means, not shown, to lock the two ends of the strap together. A handle or grip area is shown at 14 to provide a means for ease in lifting the container.

It should be understood that the assembled cylindrical container may be intended to contain a solid, liquid of fluid material that will be itself enclosed in some form of package. The form of the inner package is not a part of the present invention; the present invention is the container that contains and protects the package in its inside. It should also be understood that the container may be provided with many and varied forms of taps or spigots that may pass through the cylindrical container to the inside package and that the tap or spigot may be along the side, at the top or at the bottom of the container.

Figure 2:
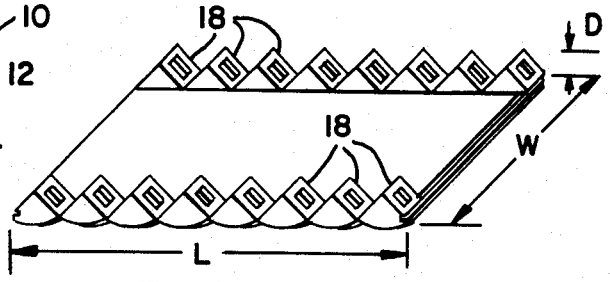
FIG. 2 is a perspective view of generally flat sheet of formable material that may be formed into the cylindrical container of FIG. 1.

The container 10 of FIG. 1 is formed from a three dimensional, generally flat, sheet stock of flexible material 16 as shown in FIG. 2 where the length dimension L of the sheet is determined by the outer circumferential dimension of the cylindrical container 10, the width dimension D of the sheet is determined by the height H of the container 10, and the depth dimension D is determined by the radius R of the container 10.

FIG. 2 illustrates the three dimensional, generally flat, sheet stock 16 in its generally flat form. As there shown, the sheet has a plurality of generally triangular sectors 18; each sector 18 has sides of equal length and the base of each sector is an equal portion of the total outside circumference of the container 10. The base of each sector is arcuate in form so that when folded into the cylindrical form the sector bases will form a generally smooth cylindrical exterior.

As shown in FIG. 2 there are eight sectors; however the number of sectors could be any number that would be easily formed from the sheet stock. The sectors 18 are at each side of the flat sheet 16 so that they form both a top and a bottom for the container as the sheet is folded into its cylindrical form. The width in the direction parallel to the dimension shown as W is determined in accord with the use to which the container is to be put. A thick sector in the width dimension would provide greater protection to the materials contained in the container, but would reduce the inside capacity of the container. In the same regard, the sectors at each side of the flat sheet need not be of the same width; that is, the top could be thinner than the bottom if desired.

Figure 3:
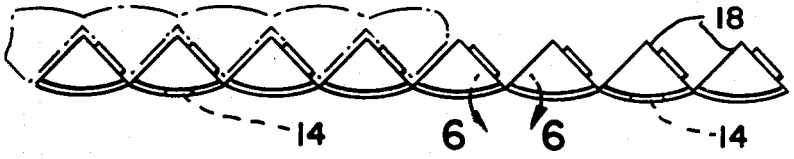
FIG. 3 is an elevational view of an edge of a sheet of formable material showing, in phantom, the stacking of two such sheets in their flat sheet form.

FIG. 3 illustrates two sheets of the generally flat form of the container stacked with each other. The second sheet is shown in phantom above the first. Because the sheets are substantially identical, they can be unfolded and mated with each other to reduce the space that is needed to store or ship the flat blank form for the material.

Figure 4:
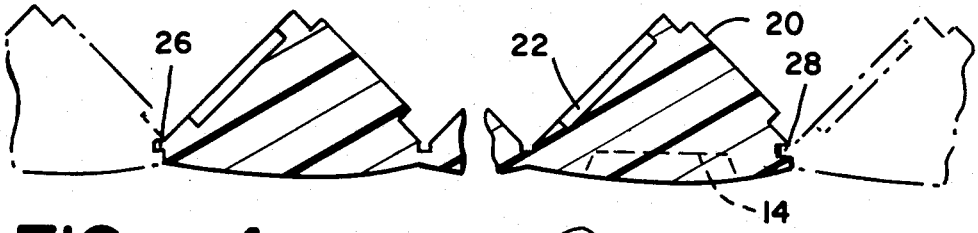
FIG. 4 is an enlarged cross-sectional view of a sheet of the formable material and showing the mateable end formations that will assist in retaining the sheet in its cylindrical form.

FIG. 4 illustrates a section through the sector 18 portion of the generally flat, sheet stock of the container. As shown in this illustration, the sectors 18 are formed with a tongue portion 20 on one side and a groove cutout 22 on the other side. The tongue 20 and groove 22 are dimensionally compatable so that they will mate with each other when the sectors are folded together. The dimension of the tongue and the groove along the sides of the sectors is not the complete length of the side to provide adequate space at the perimeter for the sectors to fold together and to permit the center of the cylindrical form to provide for a tap or spigot opening.

FIG. 4 also illustrates the formation of the ends of the sheet stock 16 with a tongue and groove formation that will assist in holding the container in its cylindrical form. As there illustrated, the opposite sides of the sheet 16 are formed with a side tongue at 26 and a side groove at 28. The tongue 26 mates with the groove 28 as the sheet stock is formed into the cylindrical form and assists in holding the cylinder in its cylindrical form.

Figure 5:
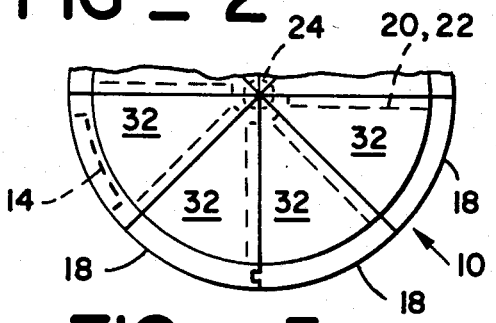
FIG. 5 is a top view of the cylindrical container of FIG. 1.

FIG. 5 illustrates in top, plan view the flat sheet formed into the cylindrical form showing the sectors joining to form a complete top (or bottom) and showing in dotted lines the mating of the tongues 20 and the grooves 22. Also shown is a possible top, center spigot opening at 24.

Figure 6:
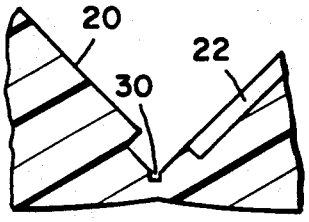
FIG. 6 is an enlarged view showing the formation of the sheet of formable material to assist in forming the sheet into the cylindrical container form.

As shown in FIG. 6, a groove 30 is formed across the width of the generally flat sheet stock at the junction of the legs of each sector 18 with the base of adjacent sectors. This groove permits the sectors to be closed against each other and permits the tongues 20 and grooves 22 to have enough space to mate with each other. When the sheet stock in folded into the cylindrical form, the grooves 30 are substantially closed against each other to provide the continuous top or bottom for the container.

Figure 7:
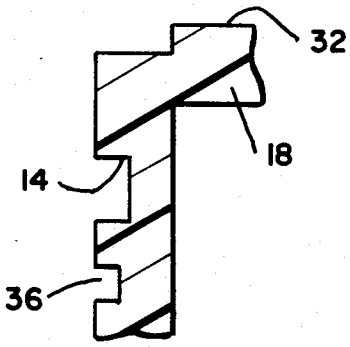
FIG. 7 is a partial sectional view of the top of the container of FIG. 1.
Figure 8:
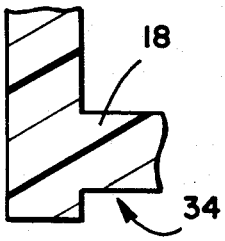
FIG. 8 is a partial sectional view of the bottom of the container of FIG. 1.

FIGS. 7 and 8 illustrate, in cross-section, the formation of mating top and bottom portions that assist in the stacking of cylindrical containers when formed in their cylindrical form. Either the top, or the bottom could be formed with an extended portion or a depression. Considering the container illustrated in FIG. 1, the top of the container is formed with an extending portion that is illustrated in FIG. 7 as a protruding portion 32 of a sector 18. FIG. 8 illustrates a depression 34 formed in a sector 18.

The container of the present invention may be formed with the suitable grooves 36 for the stripping 12 or may be formed with hand gripping areas 14, both as shown in FIG. 7 in cross-section. As previously described, the top, bottom or sides may also be constructed with suitable openings for spigots or taps as needed.

A preferred material for the formation of the generally flat, sheet stock 16 that will be formed into the cylindrical container of FIG. 1 is a foamed plastic material. Polystyrene, polyethylene, or polypropylene are materials that are easily formed into sheet stock form and are easily molded into the intricate mating forms as herein contemplated. Further, foams of such plastics may be forced into a mold of the desired shape or pellets of the plastics may be forced into the mold and there set as a unit with a suitable resin or other bonding procedure.

While a certain preferred embodiment of the present invention has been specifically disclosed, it should be understood that the invention is not limited thereto as many variations will be readily apparent to those skilled in the art and the invention is to be given its broadest possible interpertation within the terms of the following claims.

I claim:

1. A cylindrical container formed from a generally flat sheet of foamed plastic material comprising:

(a) a three dimensional sheet of foamed plastic material having a length dimension determined by the outer circumference of the container to be formed from said sheet, a width dimension determined by the height of the container to be formed from said sheet, and a depth dimension determined by the radius of the cylindrical container to be formed from said sheet, (b) said depth dimension of said sheet being formed into a plurality of triangular end sectors with the sides of said sectors having a dimension equal to the radius of said cylindrical container to be formed, (c) said triangular sectors being formed at the width dimension of said sheet and at each side of said sheet of foamed plastic material, (d) said sectors being identical isosceles triangular sector forms with the legs thereof being said radius of said cylindrical container and the arcuate base being an arc of said circumference of said container to be formed, (e) the number of said triangular sectors being determined by the flexibility of said foamed plastic material and the total base dimension of said sectors being said length of said sheet of foamed plastic material, (f) said triangular sectors having a finite dimension parallel to said width dimension of said sheet at each side of said sheet, (g) said sides of said triangular sectors being in engagement with each other along said finite dimension to form a complete top and complete bottom for said cylindrical container when so formed, (h) said triangular sectors along said finite dimension including, a tongue extension along one side leg of said sectors, a cutout portion defining a groove along the opposite legs of said sectors, and a tongue and a groove on opposite legs of adjacent sectors adapted to mate with each other when said sectors are folded against each other to form a complete cylindrical container, (i) the surface of said generally flat sheet on the side thereof having said sectors being formed with a groove extending the width of said sheet at the intersection of said legs of adjacent sectors and the base thereof, said grooves being adapted to permit said sector legs to engage each other to form said complete top and bottom of said cylindrical container, (j) said generally flat sheet of plastic material containing mating formed surfaces at said length ends of said three dimensional sheet, said mating surfaces including a cutout portion at one end and a protruding portion at the other end, said portions adapted to mate with each other to form said generally flat sheet into said cylindrical container form, (k) and the outside surfaces of said sectors in said width dimension being formed with an indented portion at one end and protuding portion at the other end, said indented and protruding portions being adapted to mate with similarly formed portions of other similarly formed cylindrical containers when aligned end-to-end at said outside surfaces.

2. The cylindrical container of claim 1 formed from a generally flat sheet of foamed plastic material therein described and wherein (a) said generally flat sheet is formed with at least one recessed groove in its length dimension on the side thereof opposite to the side containing said sectors, said groove being adapted to accomodate suitable strapping means for retaining said cylindrical container in its cylinder form when said sheet is rolled to join said sectors as said top and bottom of said formed container.

3. The cylindrical container of claim 1 formed from a generally flat sheet of foamed plastic material therein described and wherein (a) a handle means formed in said sheet of foamed plastic material on the side thereof opposite to said side containing said sectors, said handle means being formed in said surface opposite the base of a sector and centered on said sector base.

* * * * *